US010629163B2

(12) United States Patent
Yang

(10) Patent No.: US 10,629,163 B2
(45) Date of Patent: Apr. 21, 2020

(54) IMAGE PROCESSING METHOD, IMAGE PROCESSING DEVICE AND DISPLAY DEVICE

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventor: Qing Yang, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 96 days.

(21) Appl. No.: 15/953,462

(22) Filed: Apr. 15, 2018

(65) Prior Publication Data

US 2019/0114993 A1 Apr. 18, 2019

(30) Foreign Application Priority Data

Oct. 12, 2017 (CN) ..... 2017 1 0951765

(51) Int. Cl.

| | |
|---|---|
| ***G09G 3/36*** | (2006.01) |
| ***G09G 5/10*** | (2006.01) |
| ***G09G 3/20*** | (2006.01) |

(52) U.S. Cl.

CPC ..... *G09G 5/10* (2013.01); *G09G 3/2003* (2013.01); *G09G 3/3607* (2013.01); *G09G 3/3614* (2013.01); *G09G 2320/0209* (2013.01); *G09G 2320/0247* (2013.01); *G09G 2320/0666* (2013.01)

(58) Field of Classification Search

CPC ..... G09G 5/10; G09G 2320/0247

See application file for complete search history.

(56) References Cited

U.S. PATENT DOCUMENTS

2009/0213048 A1* 8/2009 Park ..... G09G 3/2003 345/77

* cited by examiner

*Primary Examiner* — Parul H Gupta

(74) *Attorney, Agent, or Firm* — Kinney & Lange, P.A.

(57) ABSTRACT

An image processing method, an image processing device, and a display device are provided. The image processing method includes: determining whether there is a pure-color pixel region in a to-be-displayed image; when there is the pure-color pixel region, performing pixel voltage compensation on pixels not arranged at the pure-color pixel region and arranged in columns identical to pixels at the pure-color pixel region in accordance with a predetermined condition, to output and display a compensated image; and when there is no pure-color pixel region, outputting the to-be-displayed image. The image processing device includes: a determination circuit determining whether there is a pure-color pixel region in a to-be-displayed image; and a compensation circuit performing pixel voltage compensation on pixels not arranged at the pure-color pixel region and arranged in columns identical to pixels at the pure-color pixel region in accordance with a predetermined condition, to output and display a compensated image.

12 Claims, 6 Drawing Sheets

IMAGE PROCESSING METHOD, IMAGE PROCESSING DEVICE AND DISPLAY DEVICE

CROSS-REFERENCE TO RELATED APPLICATION

The present application claims a priority of the Chinese patent application No. 201710951765.7 filed on Oct. 12, 2017, which is incorporated herein by reference in its entirety.

TECHNICAL FIELD

The present disclosure relates to the field of display technology, in particular to an image processing method, an image processing device, and a display device.

BACKGROUND

In some cases, such phenomenon as flicker, greenish color or crosstalk may occur for a liquid crystal display panel, which adversely affects the display quality. Therefore, it is necessary to pre-detect the possible phenomenon and process a to-be-displayed image, so as to provide a better display quality.

There are some methods in the related art, so as to detect the image with respect to flicker, noise and thermal dissipation, thereby to improve the image quality through such treatment as changing polarities.

It is found that, it is difficult and energy-consuming to detect and process a color-bar crosstalk phenomenon with the above methods.

SUMMARY

In one aspect, the present disclosure provides in some embodiments an image processing method, including: determining whether or not there is a pure-color pixel region in a to-be-displayed image; and in the case that there is the pure-color pixel region in the to-be-displayed image, performing pixel voltage compensation on pixels not arranged at the pure-color pixel region and arranged in columns identical to columns of pixels at the pure-color pixel region in accordance with a predetermined condition, so as to output and display a compensated image.

In a possible embodiment of the present disclosure, the step of determining whether or not there is the pure-color pixel region in the to-be-displayed image includes: acquiring consecutive pure-color pixel columns and consecutive pure-color pixel rows in the to-be-displayed image; and in the case that the number M of the pure-color pixel columns is greater than or equal to a first predetermined value and the number N of the pure-color pixel rows is greater than or equal to a second predetermined value, determining that there is the pure-color pixel region in the to-be-displayed image, where M and N are each a positive integer.

In a possible embodiment of the present disclosure, the step of performing the pixel voltage compensation on the pixels not arranged at the pure-color pixel region and arranged in columns identical to columns of the pixels at the pure-color pixel region in accordance with the predetermined condition includes: comparing a first grayscale of each pixel not arranged at the pure-color pixel region with a second grayscale of the corresponding pixel arranged at the pure-color pixel region in an identical column; in the case that the first grayscale is smaller than the second grayscale and a difference between the second grayscale and the first grayscale is greater than or equal to a third predetermined value, performing the pixel voltage compensation on the pixel not arranged at the pure-color pixel region; and in the case that the first grayscale is smaller than the second grayscale and the difference between the second grayscale and the first grayscale is smaller than the third predetermined value, or in the case that the first grayscale is greater than or equal to the second grayscale, not performing the pixel voltage compensation on the pixel not arranged at the pure-color pixel region.

In a possible embodiment of the present disclosure, the step of performing the pixel voltage compensation on the pixel not arranged at the pure-color pixel region includes: acquiring a voltage compensation coefficient f; determining a first polarity of a pixel voltage of each pixel not arranged at the pure-color pixel region and a second polarity of a pixel voltage of the corresponding pixel arranged at the pure-color pixel region in an identical column; in the case that the first polarity is identical to the second polarity, performing the pixel voltage compensation on the pixel not arranged at the pure-color pixel region using an equation $L1'=L1(1-f)$; and in the case that the first polarity is opposite to the second polarity, performing the pixel voltage compensation on the pixel not arranged at the pure-color pixel region using an equation $L2'=L2(1+f)$, where $L1$ and $L2$ represent pixel voltages of the pixel not arranged at the pure-color pixel region before the pixel voltage compensation, and $L1'$ and $L2'$ represent pixel voltages of the pixel not arranged at the pure-color pixel region after the pixel voltage compensation.

In a possible embodiment of the present disclosure, the step of acquiring the voltage compensation coefficient f includes: acquiring a voltage difference $\Delta V$ between each pixel at the pure-color pixel region and the corresponding pixel not arranged at the pure-color pixel region in an identical column; acquiring a distance H between the pixel at the pure-color pixel region and the corresponding pixel not arranged at the pure-color pixel region in the identical column; and acquiring the voltage compensation coefficient f using the following equation: $f=k*\Delta V/H$, where k represents a compensation factor.

In a possible embodiment of the present disclosure, the image processing method further includes, in the case that there is no pure-color pixel region in the to-be-displayed region, displaying the to-be-displayed image.

In another aspect, the present disclosure provides in some embodiments an image processing device, including: a determination circuit configured to determine whether or not there is a pure-color pixel region in a to-be-displayed image; and a compensation circuit connected to the determination circuit and configured to, in the case that there is the pure-color pixel region in the to-be-displayed image, perform pixel voltage compensation on pixels not arranged at the pure-color pixel region and arranged in columns identical to columns of pixels at the pure-color pixel region in accordance with a predetermined condition, so as to output and display a compensated image.

In a possible embodiment of the present disclosure, the determination circuit includes: an acquisition circuit configured to acquire consecutive pure-color pixel columns and consecutive pure-color pixel rows in the to-be-displayed image; and a determination sub-circuit connected to the acquisition circuit and configured to, determine whether or not the number M of the pure-color pixel columns is greater than or equal to a first predetermined value and the number N of the pure-color pixel rows is greater than or equal to a second predetermined value, if the number M of the pure-color pixel columns is greater than or equal to the first predetermined value and the number N of pure-color pixel rows is greater than or equal to the second predetermined value, determine that there is the pure-color pixel region in the to-be-displayed image, if otherwise, determine that there is no pure-color pixel region in the to-be-displayed image, where M and N are each a positive integer.

In a possible embodiment of the present disclosure, the compensation circuit includes: a comparison circuit configured to compare a first grayscale of each pixel not arranged at the pure-color pixel region with a second grayscale of the corresponding pixel arranged at the pure-color pixel region in an identical column; and a compensation sub-circuit connected to the comparison circuit and configured to, in the case that the first grayscale is smaller than the second grayscale and a difference between the second grayscale and the first grayscale is greater than or equal to a third predetermined value, perform the pixel voltage compensation on the pixel not arranged at the pure-color pixel region.

In a possible embodiment of the present disclosure, the compensation sub-circuit includes: a calculation sub-circuit configured to acquire a voltage compensation coefficient f; a polarity determination sub-circuit configured to determine a first polarity of a pixel voltage of each pixel not arranged at the pure-color pixel region and a second polarity of a pixel voltage of the corresponding pixel arranged at the pure-color pixel region in an identical column; and a selective compensation sub-circuit connected to the calculation sub-circuit and the polarity determination sub-circuit, and configured to, in the case that the first polarity is identical to the second polarity, perform the pixel voltage compensation on the pixel not arranged at the pure-color pixel region using an equation $L1'=L1(1-f)$, and in the case that the first polarity is different from the second polarity, perform the pixel voltage compensation on the pixel not arranged at the pure-color pixel region using an equation $L2'=L2(1+f)$, where L1 and L2 represent pixel voltages of the pixel not arranged at the pure-color pixel region before the pixel voltage compensation, and L1' and L2' represent pixel voltages of the pixel not arranged at the pure-color pixel region after the pixel voltage compensation.

In a possible embodiment of the present disclosure, the calculation sub-circuit includes: a first acquisition sub-circuit configured to acquire a voltage difference $\Delta V$ between each pixel at the pure-color pixel region and the corresponding pixel not arranged at the pure-color pixel region in an identical column, and acquire a distance H between the pixel at the pure-color pixel region and the corresponding pixel not arranged at the pure-color pixel region in the identical column; and a second acquisition sub-circuit configured to acquire the voltage compensation coefficient f using the following equation: $f=k*\Delta V/H$, where k represents a compensation factor.

In a possible embodiment of the present disclosure, the determination circuit is configured to perform the pixel voltage compensation on the pixels not arranged at the pure-color pixel region and arranged in columns identical to columns of the pixels at the pure-color pixel region in accordance with the predetermined condition, so as to output and display a compensated image, merely in the case that the determination circuit determines that there is the pure-color pixel region in the to-be-displayed image.

In yet another aspect, the present disclosure provides in some embodiments a display device including the above-mentioned image processing device.

The other features and advantages will be described hereinafter, and may become apparent or understandable partially from the embodiments of the present disclosure. The objects and the other advantages of the present disclosure may be implemented and acquired through structures specified in the description, claims and drawings.

BRIEF DESCRIPTION OF THE DRAWINGS

The following drawings are provided to facilitate the understanding of the present disclosure, and constitute a portion of the description. These drawings and the following embodiments are for illustrative purposes only, but shall not be construed as limiting the present disclosure.

REFERENCE SIGN LIST

Figure 1:
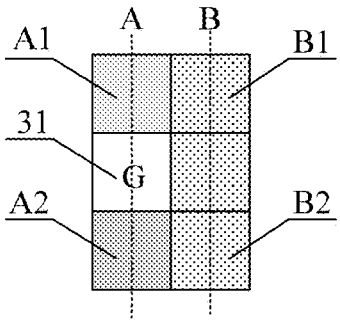
FIG. 1 is a schematic view showing a mechanism of the formation of color-bar crosstalk.

11 green subpixel
12 blue subpixel
13 red subpixel
21 first region
22 second region
31 green region
41 subpixel
42 subpixel
51 subpixel
52 subpixel

DETAILED DESCRIPTION OF THE EMBODIMENTS

In order to make the objects, the technical solutions and the advantages of the present disclosure more apparent, the present disclosure will be described hereinafter in conjunction with the drawings and embodiments. It should be appreciated that, the embodiments and the features therein may be combined in any form in the case of no conflict.

In the related art, for a Thin Film Transistor (TFT) array of a liquid crystal display panel, there is a coupling capacitance Cpd between a pixel electrode and a source electrode driving line. For a column-turnover liquid crystal display panel, in the case of displaying a pure-color pixel region in red (R), green (G) or blue (B) or in any two colors of the RGB, a high-grayscale pixel at the pure-color pixel region may be changed via the source electrode driving line. At this time, a low-grayscale pixel capacitance in a maintenance state may be charged by the coupling capacitance Cpd. In the case that a difference between a grayscale of a pixel at the pure-color pixel region and a grayscale of a pixel not at the pure-color pixel region in an identical column reaches a predetermined value and the pixel not at the pure-color pixel region is at a low grayscale, a pixel voltage of the pixel not at the pure-color pixel region may be affected by the coupling capacitance Cpd, and an actual pixel voltage of the pixel not at the pure-color pixel region may be different from an inputted pixel voltage. As a result, a blur may occur at a region above and/or below the pure-color pixel region, and thereby such a phenomenon as color-bar crosstalk may occur.

An object of the present disclosure is to provide an image processing method, an image processing device and a display device, so as to determine whether or not there is a pure-color pixel region in a to-be-displayed image, perform pixel voltage compensation on pixels not arranged at the pure-color pixel region and arranged in columns identical to columns of pixels at the pure-color pixel region in accordance with a predetermined condition, and output and display a compensated image, thereby to prevent the occurrence of the color-bar crosstalk. In addition, it is easy to implement the technical solution of the present disclosure without any additional power consumption of the display device.

Reasons for the formation of color-bar crosstalk will be described hereinafter.

FIG. 1 is a schematic view showing a mechanism of the formation of the color-bar crosstalk. In FIG. 1, 31 represents a green (G) region, a data line A corresponds to a pixel G, and a data line B corresponds to pixels adjacent to the pixel G. Due to the existence of the data line A corresponding to the pixel G, the pixel G and the adjacent pixels may be greatly affected by the coupling capacitance Cpd. In FIG. 3, by comparing a pixel A1 with a pixel B1 above the pixel G, a valid value of a pixel voltage applied to the pixel A1 is larger than that of a pixel voltage applied to the pixel B1, so the pixel A1 may emit light at a larger light intensity; and by comparing a pixel A2 with a pixel B2 below the pixel G, a valid value of a pixel voltage applied to the pixel A2 is smaller than that of a pixel voltage applied to the pixel B2, so the pixel A2 may emit light at a smaller light intensity. Hence, the regions above and below the green region 31, where the crosstalk occurs, are in colors supplementary to each other.

Figure 2:
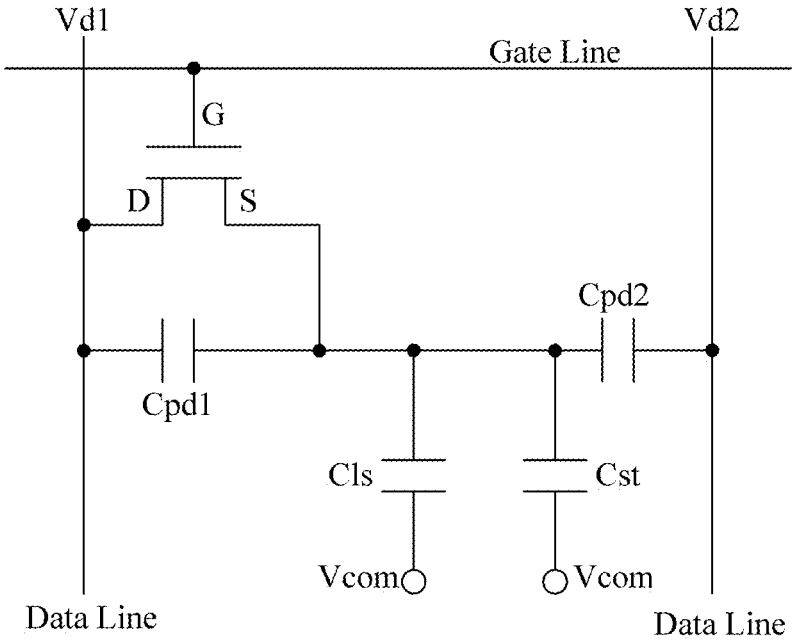
FIG. 2 is a schematic view showing a circuit regarding to the mechanism of the color-bar crosstalk.

FIG. 2 is a schematic view showing a circuit regarding to the mechanism of the color-bar crosstalk, where $V_d1$ and $V_d2$ represent voltages applied to two adjacent data lines respectively. In the case of column turnover, a change in the voltage caused by the coupling capacitance Cpd may be calculated using the following equation $$\Delta Vpxl = \frac{C_{pd}1 \times V_d1 - C_{pd}2 \times V_d2}{C_{lc} + C_{st} + C_{pd}1 + C_{pd}2}.$$

Within an alignment accuracy range, $C_{pd}1 \approx C_{pd}2$. For a grayscale image, $V_d1 = V_d2$, and ΔVpx1 is approximately equal to 0. Hence, a very small change in the pixel voltage may be caused by the coupling capacitance Cpd. However, for an image in a pure color or in two colors, $V_d1$ is not equal to $V_d2$ and there is a relatively large difference between $V_d1$ and $V_d2$, so ΔVpx1 may not be omitted, and at this time a large change in the pixel voltage may be caused by the coupling capacitance Cpd.

The mechanism of the formation of the color-bar crosstalk will be described hereinafter in more details.

Figure 3A:
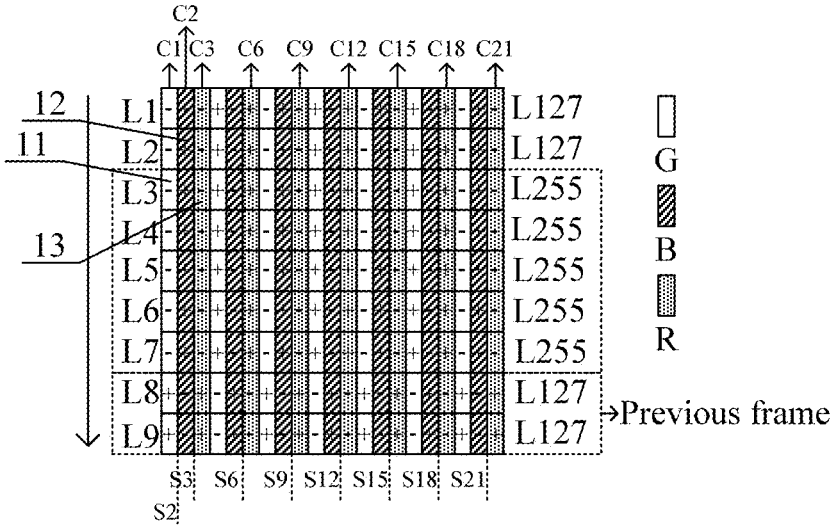
FIG. 3*a* is a schematic view showing a pixel structure of an image at a white region.

As shown in FIG. 3*a*, which is a schematic view showing an image structure of an image at a white region, rows L3 to L7 represents a white region at a grayscale of L255, rows L1 and L2 above the white region and rows L8 and L9 below the white region are gray regions at a grayscale of L127. At the bright white region, a polarity of subpixels in odd-numbered columns is opposite to a polarity of subpixels in even-numbered columns. For example, the polarity of the subpixels in column C1 is negative, the polarity of the subpixels in column C2 is positive, and the polarity of the subpixels in column C3 is negative. Due to a source electrode driving line S2 connected to subpixel 11 in row L3 and column C2, a subpixel 12 in row L2 and column C2 may be positively affected by the coupling capacitance Cpd, so a pixel voltage applied to the subpixel 12 may increase. Due to a source electrode driving line S3 for a subpixel 13 in row L3 and column C3, the subpixel 12 in row L2 and column C2 may be negatively affected by the coupling capacitance Cpd, so the pixel voltage applied to the subpixel 12 may decrease. At this time, the influences caused by the coupling capacitance Cpd on the pixel voltage applied to the subpixel 12 may cancel out each other. In the case that L3 to L7 correspond to a pure-color pixel image, there actually exists vacant subpixels, i.e., one or two of the G, B and R subpixels in L3 to L7 may be at a grayscale of L0. At this time, the influences caused by the coupling capacitance Cpd may not cancel out each other. In the case that the pure-color pixel image is displayed on the panel, the color-bar crosstalk may easily occur at a region above and/or below the pure-color pixel image.

Figure 3B:
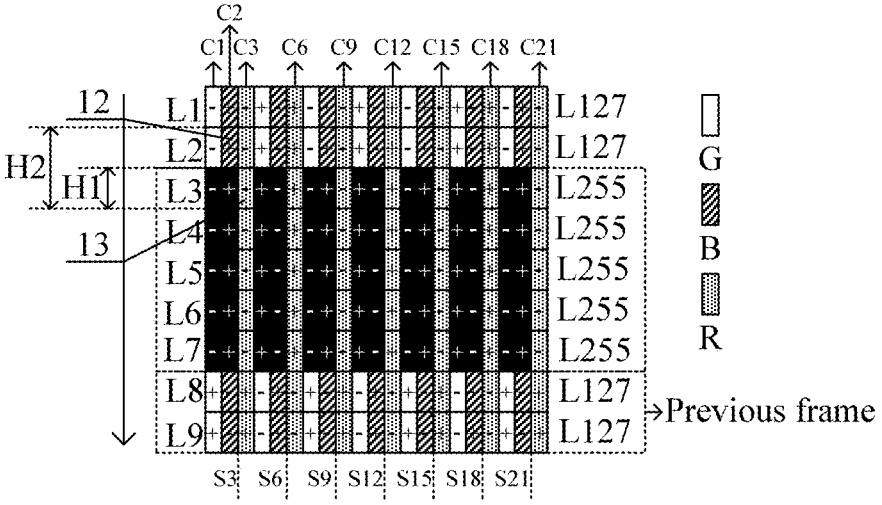
FIG. 3*b* is a schematic view showing a pixel structure of a pure-color pixel image.

As shown in FIG. 3*b* which is a schematic view showing a pixel structure of a pure-color pixel image, in the case that the pixels at the pure-color pixel region in L3 to L7 are charged from top to bottom, a polarity of red subpixels in rows L1 and L2 and column C3 is identical to a polarity of the subpixels in column C3 at the pure-color pixel region, so due to the existence of Cpd, a pixel voltage applied to the red subpixels in rows L1 and L2 and column C3 may be pulled up by a source electrode driving line S3 for the subpixels in column C3. At this time, the pixel voltage applied to the red subpixels in rows L1 and L2 and column C3 may be pulled up from L127 to L157. A polarity of blue subpixels in rows L1 and L2 and column C2 is opposite to a polarity of the subpixels in column C3 at the pure-color pixel region, so due to the existence of Cpd, a pixel voltage applied to the blue subpixels in rows L1 and L2 and column C2 may be pulled down by the source electrode driving line S3 for the subpixels in column C3. At this time, the pixel voltage applied to the blue subpixels in rows L1 and L2 and column C2 may be pulled down from L127 to L107. Hence, an upper part of the pixels at the pure-color pixel region in column C3 may emit light in a reddish color. Subpixels in L8 and L9 are used for a previous frame, so the polarity of the subpixels is opposite to that of the pixels at the pure-color pixel region in an identical column, and thereby an opposite coupling effect may be caused by the coupling capacitance Cpd. In this regard, the upper part of the pixels at the pure-color pixel region in column C3 may emit light in the reddish color, and a lower part of these pixels may emit light in a bluish color supplementary to the reddish color. At this time, the colors are obviously different from the gray color at a grayscale of L127, and thereby the color-bar crosstalk may occur at the regions above and/or below the pure-color pixel region.

Figure 3C:
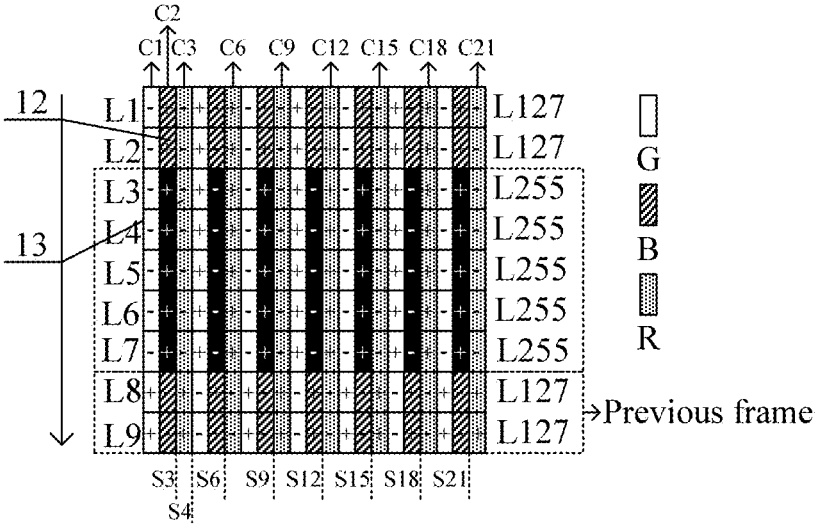
FIG. 3*c* is a schematic view showing a pixel structure of a pure-color pixel image in two colors.

As shown in FIG. 3*c* which is a schematic view showing a pixel structure of a pure-color pixel image in two colors, in the case that pink pixels at the pure-color pixel region in L3 to L7 are charged from top to bottom, a polarity of the blue subpixels in rows L1 and L2 and column C2 is opposite to a polarity of the subpixels at the pure-color pixel region in column C3, so due to the existence of the coupling capacitance Cpd, a pixel voltage applied to the blue subpixels in rows L1 and L2 and column C2 may be pulled down by the source electrode driving line S3 for the subpixels in column C3. At this time, the pixel voltage applied to the blue subpixels in rows L1 and L2 and column C2 may be pulled down from L127 to L107. Subpixels in rows L8 and L9 and column C2 are for a previous frame, and a polarity of these subpixels is identical to the polarity of the subpixels at the pure-color pixel region in column C3, so the pixel voltage applied to the blue subpixels in rows L8 and L9 and column C2 may be pulled up by the source electrode driving line S3 for the subpixels in column C3. At this time, the pixel voltage applied to the blue subpixels in rows L8 and L9 and column C2 may be pulled up from L127 to L157. In the case that the subpixels in L3 to L7 are being scanned, a positive influence on the subpixels in rows L1 and L2 and column C3 caused by the source electrode driving line S3 for the subpixels in column C3 may cancel out a negative influence on the subpixels in rows L1 and L2 and column C3 caused by a source electrode driving line S4 for the subpixels in column C4, so the subpixels in rows L1 and L2 and column C3 may not be affected by the coupling capacitance Cpd. Identically, the subpixels in rows L8 and L9 and column C3 may not be affected by the coupling capacitance Cpd either. For the subpixels in rows L1 and L2 and column C4, the pixel voltage applied thereto may be pulled up by the source electrode driving line S4 for the subpixels at the pure-color pixel region in column C4, and for the subpixels in rows L8 and L9 and column C4, the pixel voltage applied thereto may be pulled down by the source electrode driving line S4 for the subpixels at the pure-color pixel region in column C4. In this regard, an upper part of the pink pixels at the pure-color pixel region may emit light in the greenish color, and a lower part of the pink pixels may emit light in the bluish color. At this time, the colors are obviously different from the gray color at a grayscale of L127, and thereby the color-bar crosstalk may occur at the regions above and/or below the pure-color pixel region in two colors.

Due to the influence on the color-bar crosstalk caused by the coupling capacitance Cpd and the fact that human eyes are not sensitive to a change in high-grayscale brightness, it is unnecessary to perform the pixel voltage compensation on the subpixels at a grayscale greater than the subpixels at the pure-color pixel region.

In the related art, there mainly exist two schemes for solving the color-bar crosstalk phenomenon. In a first scheme, a distance between each subpixel and a corresponding subpixel driving line is increased through changing an array mask design, so as to reduce the coupling capacitance Cpd. However, this scheme is time-consuming and expensive, especially for a high Pixels Per Inch (PPI) product. Hence, it is difficult to solve the color-bar crosstalk phenomenon through changing the array mask design.

In a second scheme, the color-bar crosstalk phenomenon is solved through changing a turnover mode of liquid crystals which, however, results in an increased in the power consumption. For example, a column-turnover mode of the display panel may be changed into a row-turnover mode. At this time, in the case that the subpixels at the pure-color pixel region at a high grayscale are charged through the source electrode driving line, the influence on the subpixels at a low grayscale in an identical column caused by the coupling capacitance Cpd may be cancelled out temporally. However, as compared with the column-turnover mode, the power consumption for the row-turnover mode may increase by several times. In addition, a noise caused by the row-turnover liquid crystal display may increase, and for a touch panel, a touch effect may be greatly and adversely affected.

Figure 4:
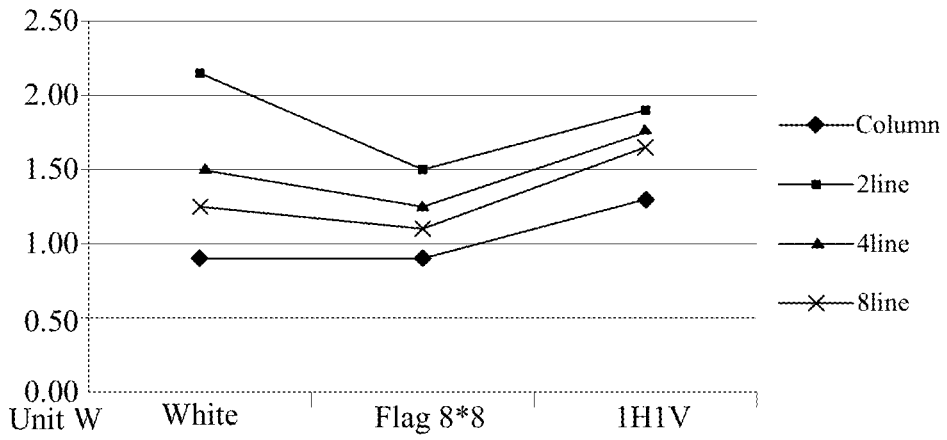
FIG. 4 is a curve diagram of data about power consumption in a row-turnover mode and a column-turnover mode for an identical panel.

FIG. 4 shows the power consumption in the row-turnover mode and the column-turnover mode for an identical panel. As shown in FIG. 4, the power consumption in the column-turnover mode is much smaller than the power consumption in the row-turnover mode, especially for a conventional white background pattern. In addition, the power consumption in a two-row-turnover mode is very large, which is unacceptable in actual use, and the power consumption in a one-row-turnover mode is even larger than that in the two-row-turnover mode. Further, for the row-turnover mode, in the case that the subpixels in each row are charged by the source electrode driving line, a charging load may be very large, regardless of being from a positive voltage to a negative voltage or from a negative voltage to a positive voltage. For the subpixels at a remote end of the panel, these subpixels may be charged insufficiently, and thereby lateral stripes may occur.

An object of the present disclosure is to provide an image processing method, an image processing device and a display device, so as to prevent the occurrence of the color-bar crosstalk in the case that a pure-color pixel image in R, G, B or in any two of them is displayed on a column-turnover liquid crystal display panel, thereby to improve the display quality. In addition, as compared with the methods for preventing the occurrence of the color-bar crosstalk in the related art, the technical solutions in the embodiments of the present disclosure may be implemented in an easier manner without any addition power consumption. The technical solutions of the present disclosure will be described hereafter in the embodiments.

Figure 5:
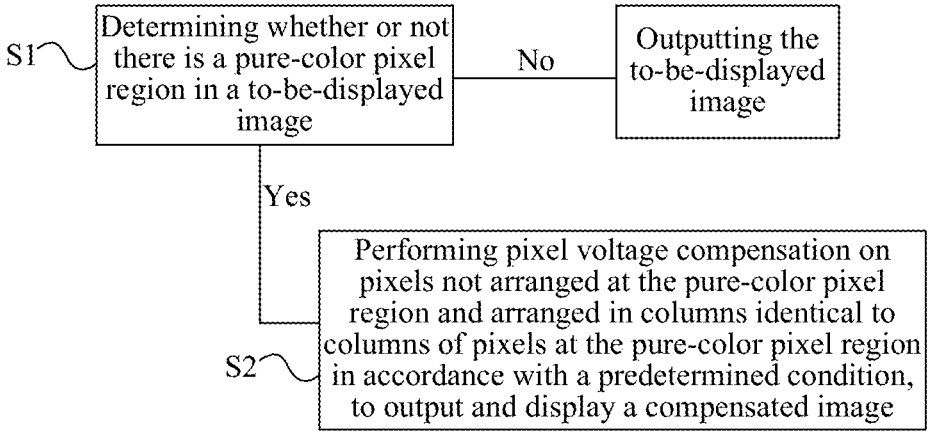
FIG. 5 is a flow chart of an image processing method according to one embodiment of the present disclosure.

The present disclosure provides in some embodiments an image processing method which, as shown in the flowchart of FIG. 5, includes: Step S1 of determining whether or not there is a pure-color pixel region in a to-be-displayed image; Step S2 of, in the case that there is the pure-color pixel region in the to-be-displayed image, performing pixel voltage compensation on pixels not arranged at the pure-color pixel region and arranged in columns identical to columns of pixels at the pure-color pixel region in accordance with a predetermined condition, so as to output and display a compensated image; and in the case that there is no pure-color pixel region in the to-be-displayed image, outputting the to-be-displayed image.

To be specific, Step S1 includes: acquiring consecutive pure-color pixel columns and consecutive pure-color pixel rows in the to-be-displayed image; and in the case that the number M of pure-color pixel columns is greater than or equal to a first predetermined value and the number N of pure-color pixel rows is greater than or equal to a second predetermined value, determining that there is the pure-color pixel region in the to-be-displayed image, where M and N are each a positive integer. The first predetermined value and the second predetermined value represent respectively the number of columns and the number of rows of the pure-color pixel region with a recognizable minimum size. Usually, Step S1 is performed by a graphics card or a timing controller (TCON).

FIG. 3*b* shows a to-be-displayed pure-color pixel image. In FIG. 3*b*, every three subpixel columns form a pixel column, e.g., C1 to C3 form a pixel column. The consecutive pure-color pixel columns acquired from the image in FIG. 3*b* include C3, C6, C9, C12, C15, C18 and C21, i.e., the number M of pure-color pixel columns is 7, and the consecutive pure-color pixel rows include L3 to L7, i.e., the number N of pure-color pixel rows is 5. The M and N may be compared with the first predetermined value and the second predetermined value respectively. In the case that M is greater than or equal to the first predetermined value and N is greater than or equal to the second predetermined value, it means that there is the pure-color pixel region in the to-be-displayed image.

In the to-be-displayed image, the first predetermined value and the second predetermined value represent respectively the number of columns and the number of rows of the pure-color pixel region with a recognizable minimum size. For a high-PPI display panel, a pure-color pixel may be identified by human eyes through a consecutive number of columns, so the first predetermined value is usually a positive integer greater than 1. For a low-PPI display panel, the pure-color pixel may be identified by the human eyes merely through one column, so the first predetermined value is usually equal to 1. Similarly, for a high-PPI display panel, a pure-color pixel may be identified by human eyes through a consecutive number of rows, so the second predetermined value is usually a positive integer greater than 1. For a low-PPI display panel, the pure-color pixel may be identified by the human eyes merely through one row, so the second predetermined value is usually equal to 1. Here, the numeric values of the first predetermined value and the second predetermined value will not be particularly defined, and they may be set in accordance with the practical need.

During the implementation, the predetermined condition in Step S2 includes that a first grayscale is smaller than a second grayscale and a difference between the first grayscale and the second grayscale is greater than or equal to a third predetermined value. Step S2 may include: comparing the first grayscale of each pixel not arranged at the pure-color pixel region with the second grayscale of the corresponding pixel arranged at the pure-color pixel region in an identical column; in the case that the first grayscale is smaller than the second grayscale and a difference between the second grayscale and the first grayscale is greater than or equal to the third predetermined value, performing the pixel voltage compensation on the pixel not arranged at the pure-color pixel region; and in the case that the first grayscale is smaller than the second grayscale and the difference between the second grayscale and the first grayscale is smaller than the third predetermined value, or in the case that the first grayscale is greater than the second grayscale, not performing the pixel voltage compensation on the pixel not arranged at the pure-color pixel region.

To be specific, the step of performing the pixel voltage compensation on the pixel not arranged at the pure-color pixel region includes: acquiring a voltage compensation coefficient f; determining a first polarity of a pixel voltage of each pixel not arranged at the pure-color pixel region and a second polarity of a pixel voltage of the corresponding pixel arranged at the pure-color pixel region in an identical column; in the case that the first polarity is identical to the second polarity, performing the pixel voltage compensation on the pixel not arranged at the pure-color pixel region using an equation $L1'=L1(1-f)$; and in the case that the first polarity is opposite to the second polarity, performing the pixel voltage compensation on the pixel not arranged at the pure-color pixel region using an equation $L2'=L2(1+f)$, where L1 and L2 represent pixel voltages of the pixel not arranged at the pure-color pixel region before the pixel voltage compensation, and L1' and L2' represent pixel voltages of the pixel not arranged at the pure-color pixel region after the pixel voltage compensation.

To be specific, the step of acquiring the voltage compensation coefficient f includes: acquiring a voltage difference $\Delta V$ between each pixel at the pure-color pixel region and the corresponding pixel not arranged at the pure-color pixel region in an identical column; acquiring a distance H between the pixel at the pure-color pixel region and the corresponding pixel not arranged at the pure-color pixel region in the identical column; and acquiring the voltage compensation coefficient f in accordance with the voltage difference $\Delta V$ and the distance H using the following equation: $f=k*\Delta V/H$, where k represents a compensation factor.

In FIG. 3*b*, the pixels not at the pure-color pixel region includes pixels in rows L1, L2, L8 and L9, and the first grayscale of the pixels in these rows L1, L2, L8 and L9 is L127. The pixels at the pure-color pixel region include pixels in rows L3 to L7, the second grayscale of the pixels in these rows L3 to L7 is L255, and the first grayscale L127 and the second grayscale L255 are compared. Obviously, the first grayscale L127 is smaller than the second grayscale L255, and a difference between the second grayscale L255 and the first grayscale L127 is 128. In the case that the difference 128 is greater than or equal to the third predetermined value, the pixel voltage compensation may be performed on the pixels not at the pure-color pixel region, i.e., the pixels in rows L1, L2, L8 and L9. Here, the third predetermined value is a minimum grayscale difference for the formation of the color-bar crosstalk. In actual use, in the case that the difference between the second grayscale and the first grayscale is smaller than the third predetermined value, it is impossible for the human eyes to identify the color-bar crosstalk, so it is unnecessary to perform the pixel voltage compensation. In the embodiments of the present disclosure, the third predetermined value is 125. The difference 128 between the second grayscale L255 and the first grayscale L127 is greater than 125, so it is necessary to perform the pixel voltage compensation on the pixels in rows L1, L2, L8 and L9. The third predetermined value may be set in accordance with the practical need, and its numeric value will not be particularly defined herein. In another embodiment of the present disclosure, for example, the third predetermined value may be 129.

In the case of performing the pixel voltage compensation on the pixels in rows L1, L2, L8 and L9, it is necessary to acquire the voltage compensation coefficient, i.e., the pixel voltage compensation may be performed in accordance with the voltage compensation coefficient f.

For example, the pixel voltage compensation may be performed on the subpixel 12 in row L2 and column C2. In order to acquire the voltage compensation coefficient, it is necessary to acquire the voltage difference ΔV between the pixel voltage applied to the subpixels 13 at the pure-color pixel region in columns C1 to C3 and the subpixel 12 not at the pure-color pixel region, as well as the distance H between the subpixel 12 and the corresponding subpixel at the pure-color pixel region. Then, the voltage compensation coefficient f may be acquired in accordance with the voltage difference ΔV and the distance H using the equation $f=k*\Delta V/H$, where k represents the compensation factor.

Through the above equation, the voltage compensation coefficient f is in reverse proportion to the distance H between the subpixel and the pixel at the pure-color pixel region. FIG. 3*b* shows a distance H2 between the subpixel in row L2 and the subpixel at the pure-color pixel region, and a distance H1 between the subpixels in row L1 and the subpixel at the pure-color pixel region. In terms of an actual display effect, since H2 is smaller than H1, in the case that the pixel at the pure-color pixel region is charged, the subpixels in row L2 may be affected by the coupling capacitance Cpd more seriously than the subpixels in row L1, which further shows that the voltage compensation coefficient f is in reverse proportion to the distance H. In actual use, the influence caused by the coupling capacitance Cpd may be obvious with respect to the subpixels in several rows. This is mainly because, due to a RC load, the larger the distance H, the smaller the coupling effect and the smaller the display difference.

A relationship between the pixel voltage compensation coefficient f and the distance H has been validated through experiments.

Figure 6A:
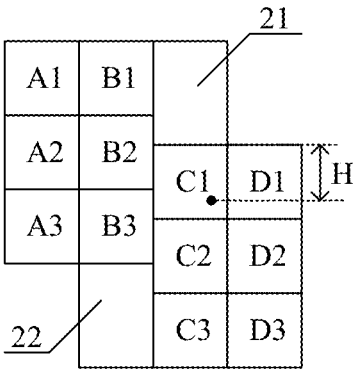
FIG. 6*a* is a schematic view showing the arrangement of pixels at a grayscale of L127.
Figure 6B:
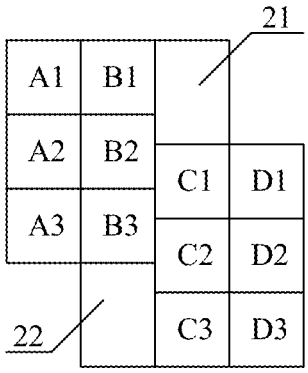
FIG. 6*b* is a schematic view showing the arrangement of pixels at a grayscale of L64.

FIG. 6*a* is a schematic view showing the arrangement of the pixels at a grayscale of L127, and FIG. 6*b* is a schematic view showing the arrangement of the pixels at a grayscale of L64. In FIGS. 6*a* and 6*b*, a first region 21 and a second region 22 are both pure-color pixel region. Table 1 shows a relationship between pixel positions and brightness data corresponding to the grayscale L127 in FIG. 6*a*, and Table 2 shows a relationship between pixel positions and brightness data corresponding to the grayscale L64 in FIG. 6*b*.

TABLE 1 pixel positions and brightness data corresponding to the grayscale L127 in FIG. 6a

| | Position | Brightness | Position | Brightness | Difference |
|---|---|---|---|---|---|
| L127 | A1 | 60 | B1 | 65.37 | 8.95% |
| | A2 | 57.16 | B2 | 65.67 | 14.89% |
| | A3 | 56 | B3 | 62 | 10.71% |
| | C1 | 65.36 | D1 | 66.6 | −1.86% |
| | C2 | 65.84 | D2 | 68 | −3.18% |
| | C3 | 64.76 | D3 | 67.8 | −4.48% |

TABLE 2 pixel positions and brightness data corresponding to the grayscale L64 in FIG. 6b

| | Position | Brightness | Position | Brightness | Difference |
|---|---|---|---|---|---|
| L64 | A1 | 13.55 | B1 | 15 | 10.70% |
| | A2 | 13.32 | B2 | 15.12 | 13.51% |
| | A3 | 13.26 | B3 | 15.05 | 13.50% |
| | C1 | 14.84 | D1 | 14.92 | −0.54% |
| | C2 | 15 | D2 | 15.76 | −4.82% |
| | C3 | 14.76 | D3 | 15.51 | −4.84% |

As shown in FIGS. 6*a*, 6*b* in conjunction with Table 1 and Table 2, the difference between B3 and A3 in Table 1 and Table 2 is in direct proportion to a brightness difference. In terms of positions of the pixels, there is no strict rule for the position difference, and the position difference may be easily affected by light transmittance, evenness and backlight evenness of the panel. Based on the data about B2 and B1, the farther the distance between the subpixel and the pixel at the pure-color pixel region, the smaller the difference and the smaller the pixel voltage compensation coefficient, i.e., the pixel voltage compensation coefficient is in reverse proportion to the distance.

A result of the pixel voltage compensation may also be affected by the polarity of the pixel voltage applied to the pixel. In the case that the pixel voltage compensation is performed on the pixel not at the pure-color pixel region using the pixel voltage compensation coefficient f, at first the first polarity of the pixel voltage applied to the pixel not at the pure-color pixel region and the second polarity of the pixel voltage applied to the pixel at the pure-color pixel region may be determined. In the case that the first polarity is identical to the second polarity, the pixel voltage compensation may be performed on the pixel not at the pure-color pixel region using the equation $L1'=L1(1-f)$. In the case that the first polarity is different from the second polarity, the pixel voltage compensation may be performed on the pixel not at the pure-color pixel region using the equation $L2'=L2(1+f)$. L1 and L2 are the pixel voltages before the pixel voltage compensation, and L1' and L2' are the pixel voltages after the pixel voltage compensation.

For example, in FIG. 3*b*, in the case that the pixel voltage compensation is to be performed on the blue subpixel 12 in row L2 and column C2, the first polarity of the pixel voltage applied to the blue subpixel 12 is opposite to the second polarity of the pixel voltage applied to the red subpixels 13 at the pure-color pixel region in column C3, so the pixel voltage compensation may be performed using the equation $L2'=L2(1+f)$. In the case that the pixel voltage compensation is to be performed on the red subpixel in row L2 and column C3, the first polarity of the pixel voltage applied to the red subpixel is identical to the second polarity of the pixel voltage applied to the red subpixels 13 at the pure-color pixel region in column C3, so the pixel voltage compensation may be performed using the equation $L2'=L2(1-f)$. In this way, the pixel voltage which has been pulled up may be pulled down, and the pixel voltage which has been pulled down may be pulled up, so as to reduce the influence on the pixel voltage caused by the coupling capacitance Cpd.

Figure 7A:
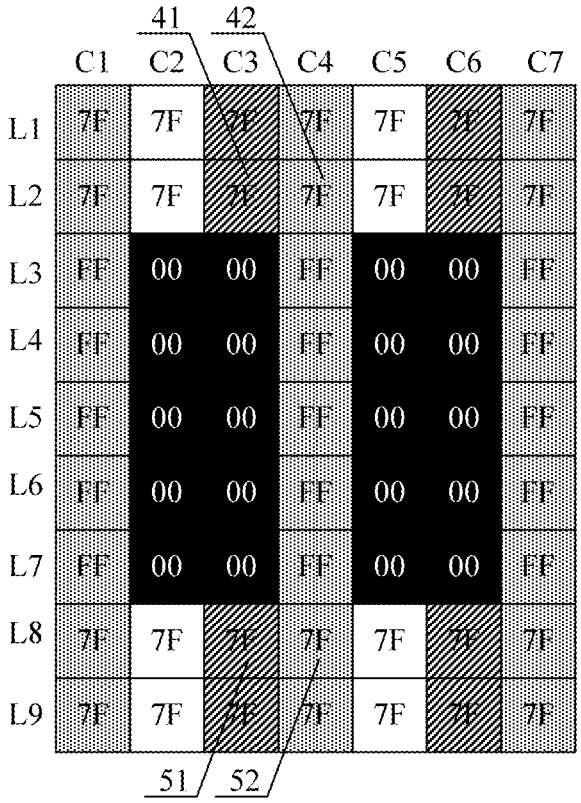
FIG. 7*a* is a schematic view showing a to-be-displayed pure-color image.
Figure 7B:
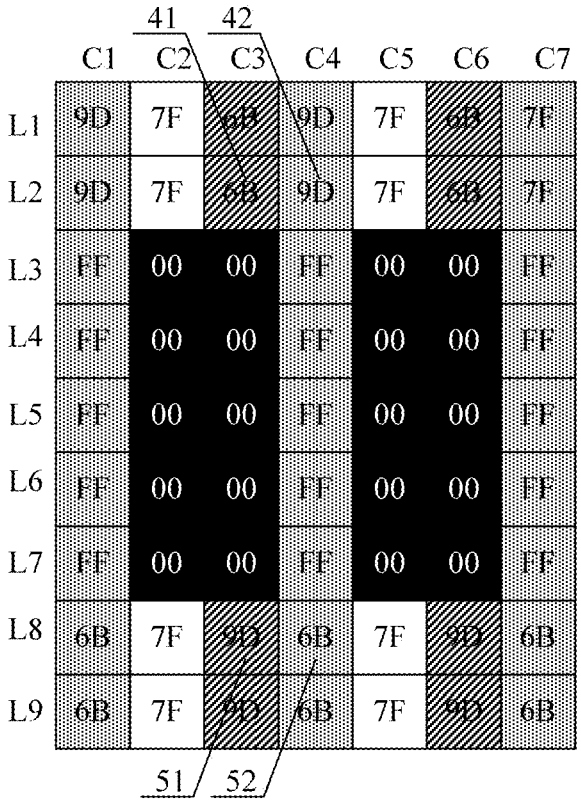
FIG. 7*b* is a schematic view showing an image outputted in the case that no pixel voltage compensation is performed on the to-be-displayed pure-color image in FIG. 7*a;*
Figure 7C:
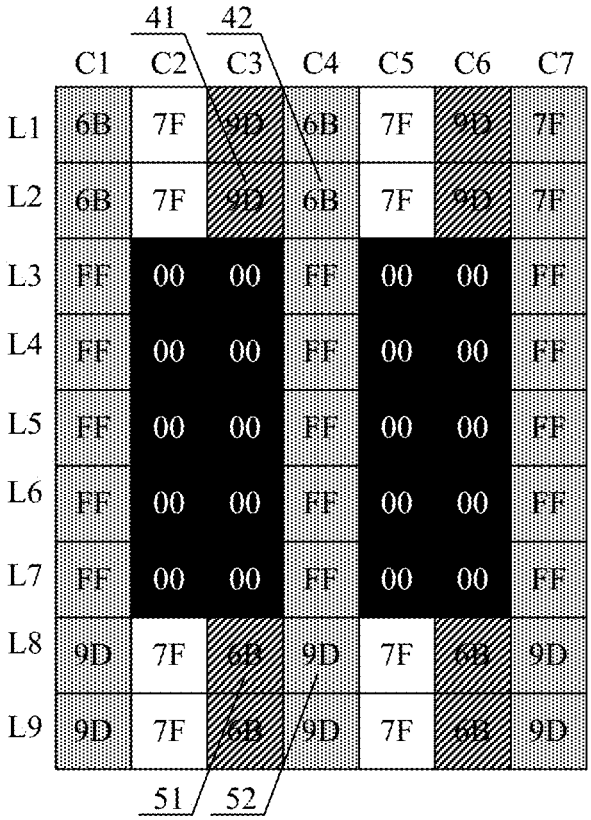
FIG. 7*c* is a schematic view showing the pixel voltage compensation on the to-be-displayed pure-color image in FIG. 7*a;*
Figure 7D:
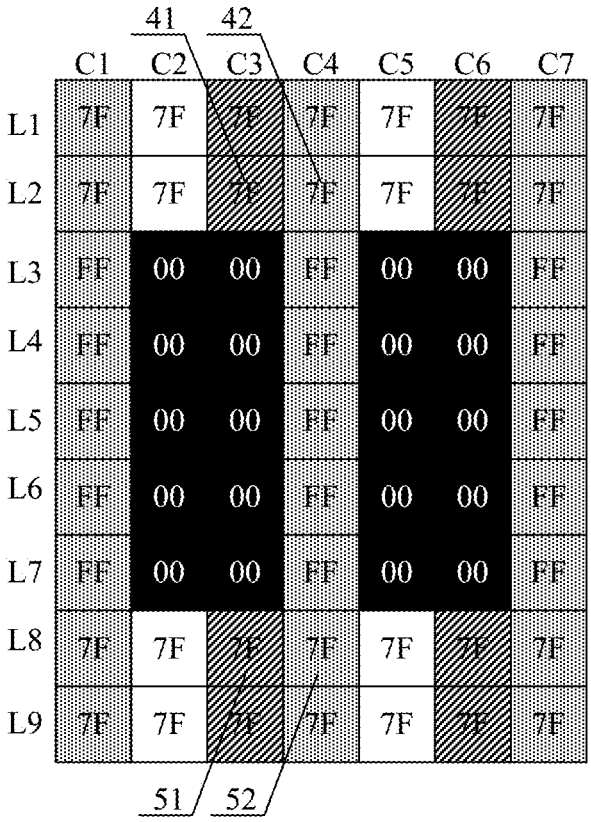
FIG. 7*d* is a schematic view showing an image outputted after the pixel voltage compensation on the to-be-displayed pure-color image in FIG. 7*a;*

FIGS. 7*a* to 7*d* show the images before and after the pixel voltage compensation for an actual pure-color image. FIG. 7*a* shows a pure-color image to be displayed, and FIG. 7*b* shows an image outputted in the case that no pixel voltage compensation is performed on the image in FIG. 7*a*. In FIG. 7*a*, the pixels in rows L3 to L7 form a pure-color pixel region, the pixels in rows L1 and L2 are arranged above the pure-color pixel region, and the pixels in rows L8 and L9 are arranged below the pure-color pixel region. A subpixel 41 and a subpixel 42 are arranged above the subpixels at the pure-color pixel region in column C4, and a subpixel 51 and a subpixel 52 are arranged there below. As shown in FIG. 7*a*, each of the pixel voltages respectively applied to the subpixels 41, 42, 51 and 52 in the to-be-displayed image is 7F. In the case that no pixel voltage compensation is to be performed, an actually-outputted image is shown in FIG. 7*b*. As shown in FIG. 7*b*, due to the existence of the coupling capacitance Cpd, the pixel voltage actually applied to the subpixel 41 is 6B, the pixel voltage actually applied to the subpixel 42 is 9D, the pixel voltage actually applied to the subpixel 51 is 9D, and the pixel voltage actually applied to the subpixel 52 is 6B. In other words, the actually-applied pixel voltages are different from the voltage 7F, so the color-bar crosstalk may occur and the image may be displayed abnormally. FIG. 7*c* is a schematic view showing the pixel voltage compensation on the image in FIG. 7*a*. Through the image processing method in the embodiments of the present disclosure, it is able to perform the pixel voltage compensation on the subpixels 41, 42, 51 and 52 affected by the coupling capacitance Cpd. After the pixel voltage compensation, the compensation data for the subpixel 41 may be 9D, the compensation data for the subpixel 42 may be 6B, the compensation data for the subpixel 51 may be 6B, and compensation data for the subpixel 52 may be 9D, so as to obtain the image acquired after the pixel voltage compensation on the image in FIG. 7*a* as shown in FIG. 7*d*. In FIG. 7*d*, the pixel voltages applied to the subpixels 41, 42, 51 and 52 are identical to those in FIG. 7*a* respectively, so the actually-outputted image may be identical to the to-be-displayed image.

The image processing method in the embodiments of the present disclosure has the following advantages. (1) The pixel voltage compensation is performed using an encoding method, without any additional design cost or any additional manufacture time. (2) Through a flexible encoding method, it is able to determine the compensation coefficient in accordance with a brightness difference between the pixel at the pure-color pixel region and the pixel at a low-grayscale region, thereby to output the image accurately. (3) As compared with the scheme where the turnover mode is changed so as to prevent the crosstalk, it is able for the method in the embodiments of the present disclosure to reduce the power consumption of the display panel, as well as the noise for a touch panel.

According to the image processing method in the embodiments of the present disclosure, through the encoding method, it is able to perform the pixel voltage compensation easily without any additional design cost. In addition, during the implementation, it is unnecessary to change the column-turnover mode to the row-turnover mode, so as to reduce the power consumption of the display device, and reduce the contact noise in the case that the method is used for attaching the touch panel. Further, through the flexible encoding method, it is able to output the image more accurately in accordance with the determined compensation coefficient.

Figure 8:
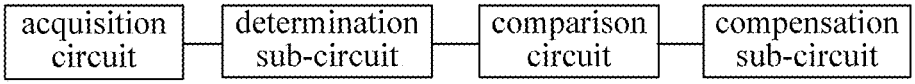
FIG. 8 is a schematic view showing an image processing device according to one embodiment of the present disclosure.

Based on an inventive concept identical to that of the embodiments of FIGS. 5-7*d*, the present disclosure further provides in some embodiments an image processing device which, as shown in FIG. 8, includes: a determination circuit configured to determine whether or not there is a pure-color pixel region in a to-be-displayed image; and a compensation circuit connected to the determination circuit, and configured to perform pixel voltage compensation on pixels not arranged at the pure-color pixel region and arranged in columns identical to columns of pixels at the pure-color pixel region in accordance with a predetermined condition, so as to output and display a compensated image.

In a possible embodiment of the present disclosure, the determination circuit may include: an acquisition circuit configured to acquire pure-color pixel columns and pure-color pixel rows in the to-be-displayed image; and a determination sub-circuit connected to the acquisition circuit and configured to, determine whether or not the number M of pure-color pixel columns is greater than or equal to a first predetermined value and the number N of pure-color pixel rows is greater than or equal to a second predetermined value, if the number M of pure-color pixel columns is greater than or equal to the first predetermined value and the number N of pure-color pixel rows is greater than or equal to the second predetermined value, determine that there is the pure-color pixel region in the to-be-displayed image, if otherwise, determine that there is no pure-color pixel region in the to-be-displayed image, where M and N are each a positive integer. The first predetermined value and the second predetermined value represent respectively the number of columns and the number of rows of the pure-color pixel region with a recognizable minimum size.

In a possible embodiment of the present disclosure, the compensation circuit may include: a comparison circuit configured to compare a first grayscale of each pixel not arranged at the pure-color pixel region with a second grayscale of the corresponding pixel arranged at the pure-color pixel region in an identical column; and a compensation sub-circuit connected to the comparison circuit, and configured to, in the case that the first grayscale is smaller than the second grayscale and a difference between the second grayscale and the first grayscale is greater than or equal to a third predetermined value, perform the pixel voltage compensation on the pixel not arranged at the pure-color pixel region. The third predetermined value is a minimum grayscale difference capable of forming the color-bar crosstalk.

Figure 9:
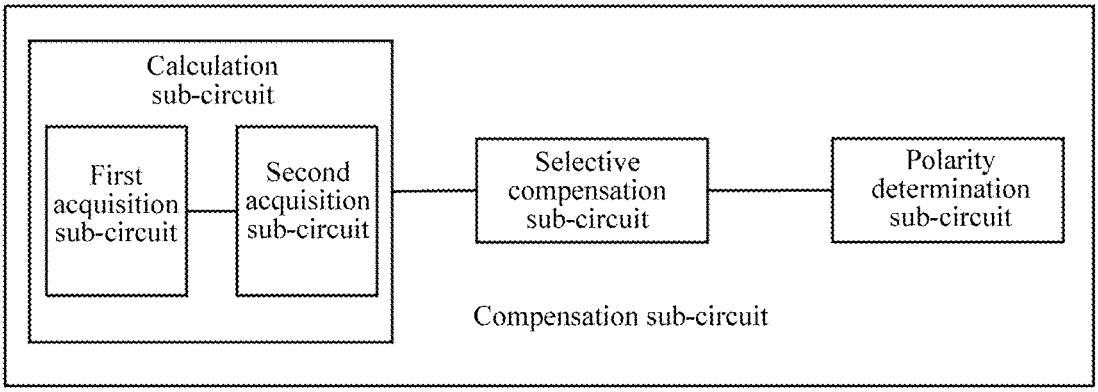
FIG. 9 is a schematic view showing a compensation sub-circuit according to one embodiment of the present disclosure.

As shown in FIG. 9, the compensation sub-circuit may include: a calculation sub-circuit configured to acquire a voltage compensation coefficient f; a polarity determination sub-circuit configured to determine a first polarity of a pixel voltage of each pixel not arranged at the pure-color pixel region and a second polarity of a pixel voltage of the corresponding pixel arranged at the pure-color pixel region in an identical column; and a selective compensation sub-circuit connected to the calculation sub-circuit and the polarity determination sub-circuit, and configured to, in the case that the first polarity is identical to the second polarity, perform the pixel voltage compensation on the pixel not arranged at the pure-color pixel region using an equation $L1'=L1(1-f)$, and in the case that the first polarity is different from the second polarity, perform the pixel voltage compensation on the pixel not arranged at the pure-color pixel region using an equation $L2'=L2(1+f)$, where L1 and L2 represent pixel voltages of the pixel not arranged at the pure-color pixel region before the pixel voltage compensation, and L1' and L2' represent pixel voltages of the pixel not arranged at the pure-color pixel region after the pixel voltage compensation.

In a possible embodiment of the present disclosure, the calculation sub-circuit includes: a first acquisition sub-circuit configured to acquire a voltage difference $\Delta V$ between each pixel at the pure-color pixel region and the corresponding pixel not arranged at the pure-color pixel region in an identical column, and acquire a distance H between the pixel at the pure-color pixel region and the corresponding pixel not arranged at the pure-color pixel region in the identical column; and a second acquisition sub-circuit connected to the first acquisition sub-circuit, and configured to acquire the voltage compensation coefficient f using the following equation: $f=k*\Delta V/H$, where k represents a compensation factor.

Based on an identical inventive concept, the present disclosure further provides in some embodiments a display device including the above-mentioned image processing device. The display device may be any product or member having a display function, e.g., a liquid crystal panel, an electronic paper, an Organic Light-Emitting Diode (OLED) panel, a mobile phone, a flat-panel computer, a television, a display, a laptop computer, a digital photo frame or a navigator.

It should be appreciated that, in the embodiments of the present disclosure, such words as "in the middle", "on", "under", "front", "back", "vertical", "horizontal", "top", "bottom", "inside" and "outside" are merely used for facilitating and simplifying the description, and they may merely each refer to a direction or a position relationship as shown in the drawings, but shall not be used to indicate or imply that the device or member must be arranged or operated at a specific position. The present disclosure is not limited thereto.

Unless otherwise defined or specified, such words as "install", "connect" and "connected to" shall have the general meaning, e.g., they may each refer to: a fixed connection state, a removable connection state or an integral connection state; mechanical connection or electrical connection; or direct connection or indirect connection through an intermediate medium; or communication between internals of two elements. The above-mentioned words may have the common meanings understood by a person of ordinary skills.

The above are merely the preferred embodiments of the present disclosure, but the present disclosure is not limited thereto. Obviously, a person skilled in the art may make further modifications and improvements without departing from the spirit and scope of the present disclosure, and these modifications and improvements shall also fall within the scope of the present disclosure. The protection scope of the present disclosure is defined by the attached claims.

What is claimed is:

1. An image processing method, comprising:

determining whether or not there is a pure-color pixel region in a to-be-displayed image; and upon determining that there is the pure-color pixel region in the to-be-displayed image, performing pixel voltage compensation on pixels not arranged at the pure-color pixel region and arranged in columns identical to columns of pixels at the pure-color pixel region in accordance with a predetermined condition, to output and display a compensated image, wherein the step of performing the pixel voltage compensation on the pixels not arranged at the pure-color pixel region and arranged in the columns identical to the columns of the pixels at the pure-color pixel region in accordance with the predetermined condition comprises:

comparing a first grayscale of each pixel not arranged at the pure-color pixel region with a second grayscale of a corresponding pixel arranged at the pure-color pixel region in an identical column; and if the first grayscale is smaller than the second grayscale and a difference between the second grayscale and the first grayscale is greater than or equal to a third predetermined value, performing the pixel voltage compensation on the pixel not arranged at the pure-color pixel region; and wherein the step of performing the pixel voltage compensation on the pixel not arranged at the pure-color pixel region comprises:

acquiring a voltage compensation coefficient f;

determining a first polarity of a pixel voltage of each pixel not arranged at the pure-color pixel region and a second polarity of a pixel voltage of the corresponding pixel arranged at the pure-color pixel region in the identical column;

if the first polarity is identical to the second polarity, performing the pixel voltage compensation on the pixel not arranged at the pure-color pixel region using an equation $L1'=L1(1-f)$; and if the first polarity is different from the second polarity, performing the pixel voltage compensation on the pixel not arranged at the pure-color pixel region using an equation $L2'=L2(1+f)$, where L1 and L2 represent pixel voltages of the pixel not arranged at the pure-color pixel region before the pixel voltage compensation, and L1' and L2' represent pixel voltages of the pixel not arranged at the pure-color pixel region after the pixel voltage compensation.

2. The image processing method according to claim 1, wherein the step of determining whether or not there is the pure-color pixel region in the to-be-displayed image comprises:

acquiring consecutive pure-color pixel columns and consecutive pure-color pixel rows in the to-be-displayed image; and if the number M of the consecutive pure-color pixel columns is greater than or equal to a first predetermined value, and the number N of the consecutive pure-color pixel rows is greater than or equal to a second predetermined value, determining that there is the pure-color pixel region in the to-be-displayed image, where M and N are each a positive integer.

3. The image processing method according to claim 1, wherein the step of acquiring the voltage compensation coefficient f comprises:

acquiring a voltage difference $\Delta V$ between each pixel at the pure-color pixel region and a corresponding pixel not arranged at the pure-color pixel region in the identical column;

acquiring a distance H between the pixel at the pure-color pixel region and the corresponding pixel not arranged at the pure-color pixel region in the identical column; and acquiring the voltage compensation coefficient f using the following equation: $f=k*\Delta V/H$, where k represents a compensation factor.

4. The image processing method according to claim 1, further comprising, in a case that there is no pure-color pixel region in the to-be-displayed region, displaying the to-be-displayed image.

5. An image processing device, comprising:

a determination circuit configured to determine whether or not there is a pure-color pixel region in a to-be-displayed image; and a compensation circuit connected to the determination circuit, and configured to perform pixel voltage compensation on pixels not arranged at the pure-color pixel region and arranged in columns identical to columns of pixels at the pure-color pixel region in accordance with a predetermined condition, to output and display a compensated image, wherein the compensation circuit comprises:

a comparison circuit configured to compare a first grayscale of each pixel not arranged at the pure-color pixel region with a second grayscale of a corresponding pixel arranged at the pure-color pixel region in an identical column; and a compensation sub-circuit connected to the comparison circuit and configured to, if the first grayscale is smaller than the second grayscale and a difference between the second grayscale and the first grayscale is greater than or equal to a third predetermined value, perform the pixel voltage compensation on the pixel not arranged at the pure-color pixel region; and wherein the compensation sub-circuit comprises:

a calculation sub-circuit configured to acquire a voltage compensation coefficient f;

a polarity determination sub-circuit configured to determine a first polarity of a pixel voltage of each pixel not arranged at the pure-color pixel region and a second polarity of a pixel voltage of the corresponding pixel arranged at the pure-color pixel region in the identical column; and a selective compensation sub-circuit connected to the calculation sub-circuit and the polarity determination sub-circuit, and configured to, if the first polarity is identical to the second polarity, perform the pixel voltage compensation on the pixel not arranged at the pure-color pixel region using an equation $L1'=L1(1-f)$, and if the first polarity is different from the second polarity, perform the pixel voltage compensation on the pixel not arranged at the pure-color pixel region using an equation $L2'=L2(1+f)$, where L1 and L2 represent pixel voltages of the pixel not arranged at the pure-color pixel region before the pixel voltage compensation, and L1' and L2' represent pixel voltages of the pixel not arranged at the pure-color pixel region after the pixel voltage compensation.

6. The image processing device according to claim 5, wherein the determination circuit comprises:

an acquisition circuit configured to acquire consecutive pure-color pixel columns and consecutive pure-color pixel rows in the to-be-displayed image; and a determination sub-circuit connected to the acquisition circuit, and configured to determine whether or not a number M of the consecutive pure-color pixel columns is greater than or equal to a first predetermined value, and determine whether or not a number N of the consecutive pure-color pixel rows is greater than or equal to a second predetermined value, and if the number M of the consecutive pure-color pixel columns is greater than or equal to the first predetermined value, and the number N of the consecutive pure-color pixel rows is greater than or equal to the second predetermined value, to determine that there is the pure-color pixel region in the to-be-displayed image, and if the number M of the consecutive pure-color pixel columns is less than the first predetermined value, or the number N of the consecutive pure-color pixel rows is less than the second predetermined value, or the number M of the consecutive pure-color pixel columns is less than the first predetermined value and the number N of the consecutive pure-color pixel rows is less than the second predetermined value, to determine that there is no pure-color pixel region in the to-be-displayed image, where M and N are each a positive integer.

7. The image processing device according to claim 5, wherein the calculation sub-circuit comprises:

a first acquisition sub-circuit configured to acquire a voltage difference ΔV between each pixel at the pure-color pixel region and the corresponding pixel not arranged at the pure-color pixel region in the identical column, and acquire a distance H between the pixel at the pure-color pixel region and the corresponding pixel not arranged at the pure-color pixel region in the identical column; and a second acquisition sub-circuit configured to acquire the voltage compensation coefficient f using the following equation: $f=k*\Delta V/H$, where k represents a compensation factor.

8. The image processing device according to claim 5, wherein the determination circuit is configured to perform the pixel voltage compensation on the pixels not arranged at the pure-color pixel region and arranged in the columns identical to the columns of the pixels at the pure-color pixel region in accordance with the predetermined condition, to output and display the compensated image, if the determination circuit determines that there is the pure-color pixel region in the to-be-displayed image.

9. A display device, comprising the image processing device according to claim 5.

10. The display device according to claim 9, wherein the determination circuit comprises:

an acquisition circuit configured to acquire consecutive pure-color pixel columns and consecutive pure-color pixel rows in the to-be-displayed image; and a determination sub-circuit connected to the acquisition circuit, and configured to determine whether or not a number M of the consecutive pure-color pixel columns is greater than or equal to a first predetermined value, and determine whether or not a number N of the consecutive pure-color pixel rows is greater than or equal to a second predetermined value, and if the number M of the consecutive pure-color pixel columns is greater than or equal to the first predetermined value, and the number N of the consecutive pure-color pixel rows is greater than or equal to the second predetermined value, to determine that there is the pure-color pixel region in the to-be-displayed image, and if the number M of the consecutive pure-color pixel columns is less than the first predetermined value, or the number N of the consecutive pure-color pixel rows is less than the second predetermined value, or the number M of the consecutive pure-color pixel columns is less than the first predetermined value and the number N of the consecutive pure-color pixel rows is less than the second predetermined value, to determine that there is no pure-color pixel region in the to-be-displayed image, where M and N are each a positive integer.

11. The display device according to claim 9, wherein the calculation sub-circuit comprises:

a first acquisition sub-circuit configured to acquire a voltage difference ΔV between each pixel at the pure-color pixel region and the corresponding pixel not arranged at the pure-color pixel region in the identical column, and acquire a distance H between the pixel at the pure-color pixel region and the corresponding pixel not arranged at the pure-color pixel region in the identical column; and a second acquisition sub-circuit configured to acquire the voltage compensation coefficient f using the following equation: $f=k*\Delta V/H$, where k represents a compensation factor.

12. The display device according to claim 9, wherein the determination circuit is configured to perform the pixel voltage compensation on the pixels not arranged at the pure-color pixel region and arranged in columns identical to columns of the pixels at the pure-color pixel region in accordance with the predetermined condition, to output and display the compensated image, if that the determination circuit determines that there is the pure-color pixel region in the to-be-displayed image.

* * * * *